US007909944B2

(12) United States Patent
Inbe et al.

(10) Patent No.: US 7,909,944 B2
(45) Date of Patent: Mar. 22, 2011

(54) SURFACE CONDITIONING COMPOSITION AND SURFACE CONDITIONING METHOD

(75) Inventors: Toshio Inbe, Tokyo (JP); Yusuke Wada, Tokyo (JP); Masahiko Matsukawa, Tokyo (JP); Kotaro Kikuchi, Tokyo (JP)

(73) Assignee: Chemetall GmbH, Frankfurt am Main (DE)

( * ) Notice: Subject to any disclaimer, the term of this patent is extended or adjusted under 35 U.S.C. 154(b) by 711 days.

(21) Appl. No.: 11/891,278

(22) Filed: Aug. 9, 2007

(65) Prior Publication Data

US 2008/0041498 A1 Feb. 21, 2008

Related U.S. Application Data

(63) Continuation of application No. PCT/JP2007/051943, filed on Feb. 5, 2007.

(30) Foreign Application Priority Data

Feb. 3, 2006 (JP) ..... 2006-027562

(51) Int. Cl.
*C23C 22/07* (2006.01)
*C23C 22/80* (2006.01)

(52) U.S. Cl. ..... 148/260; 148/243; 148/247; 148/253; 148/254; 148/259; 148/274; 106/14.05; 106/14.11; 106/14.12; 106/14.15; 106/14.37; 106/14.41; 106/14.42; 106/14.44

(58) Field of Classification Search ..... 106/14.05, 106/14.11, 14.12, 14.15, 14.37, 14.41, 14.42, 106/14.44; 148/243, 247, 253, 254, 259–260, 148/274

See application file for complete search history.

(56) References Cited

U.S. PATENT DOCUMENTS

| | | | | |
|---|---|---|---|---|
| 3,892,577 A | * | 7/1975 | Sugahara et al. | 106/14.12 |
| 4,497,667 A | | 2/1985 | Vashi | |
| 5,160,551 A | | 11/1992 | Rein et al. | |

FOREIGN PATENT DOCUMENTS

| | | |
|---|---|---|
| CA | 937139 | * 11/1973 |
| CA | 2088342 | 7/1993 |
| DE | 2034627 | 2/1972 |
| EP | 554179 | 8/1993 |
| JP | 60-39171 | 2/1985 |
| JP | 04-254589 | 9/1992 |
| JP | 05-247664 | 9/1993 |

* cited by examiner

*Primary Examiner* — Roy King
*Assistant Examiner* — Lois Zheng
(74) *Attorney, Agent, or Firm* — Dilworth & Barrese, LLP

(57) ABSTRACT

A surface conditioning composition is provided in which a titanium phosphate compound can be stored in the state of a dispersion liquid for a long period of time while being stably present in the dispersion liquid, with favorable stability also in the bath, and with the composition being capable of forming a conversion coating film in a sufficient amount of the film even in the case of application to conversion resistant metal materials such as high-tensile steel sheets.

8 Claims, No Drawings

SURFACE CONDITIONING COMPOSITION AND SURFACE CONDITIONING METHOD

This is a CONTINUATION of copending PCT application Serial No. PCT/JP2007/051943 filed Feb. 5, 2007.

TECHNICAL FIELD

The present invention relates to a surface conditioning composition, and a surface conditioning method.

BACKGROUND ART

Automotive bodies, home electrical appliances and the like have been manufactured with metal materials such as steel sheets, galvanized steel sheets, and aluminum-based metal materials. In general, after being subjected to a chemical conversion treatment step as a pretreatment, a treatment such as coating is carried out. For the chemical conversion treatment, a phosphate treatment is generally carried out. In the chemical conversion treatment with phosphate, a surface conditioning treatment is generally carried out as a preceding process for allowing fine and dense phosphate crystals to be deposited on the metal material surface.

Examples of known surface conditioning compositions for use in such a surface conditioning treatment include treatment liquids containing a titanium phosphate compound referred to as a Jernstedt salt. However, titanium phosphate particles are disadvantageous in that sufficient stability may not be achieved in liquids.

Hence, stable storage for a long period of time in the state of a concentrated liquid has been difficult; therefore, the composition is stored in the state of powder, and a bath is prepared for use by dispersing in a solution. However, for the purpose of simplifying the step, a titanium phosphate-based surface conditioning agent, which would enable storage for a long period of time in the state of liquid, has been desired. In addition, long term stability of the bath has been also desired.

Furthermore, because of such instability, a great influence may be exerted when metal ions such as magnesium ions and calcium ions in tap water contaminate the bath, and result in sedimentation of the titanium phosphate compound. Accordingly, it is necessary to newly prepare the surface conditioning bath in succession.

Moreover, functions per se as a surface conditioning agent could not be considered to be satisfactory. Among metal substrates, some substrates readily cause a chemical conversion treatment reaction, while other substrates hardly cause the reaction. For example, according to conversion resistant metal materials such as aluminum-based metal materials and high-tensile steel sheets, the reaction caused by the phosphate treatment is generally hard to progress, and thus, it has been believed to be difficult to form the conversion coating film in a sufficient amount. Even though such substrates are subjected to a treatment with a treatment liquid including a conventional Jernstedt salt as a principal component, allowing the chemical conversion treatment reaction to progress is difficult. Therefore, a surface conditioning agent having a function to address these conversion resistant metal materials has been desired. In particular, when a surface conditioning agent which can address many kinds of metal substrates can be obtained, many kinds of metals can be subjected to the chemical conversion treatment at once, thereby enabling the chemical conversion treatment to affect a subject composed of many kinds of metal species.

In addition, even in the case of substrates on which the treatment with the Jernstedt salt can be perfected like iron-based substrates and zinc-based substrates, further improvement of the performances is expected by enhancing functions of the surface conditioning agent.

For example, Patent Document 1 discloses a treatment liquid containing the Jernstedt salt, a particular phosphonate salt, and a particular polysaccharide resin. However, the stabilizing effect was not satisfactory even with this treatment liquid, thereby not having enough stability in the state of a concentrated liquid. Rather, functions in terms of surface conditioning may be deteriorated.

Moreover, Patent Document 2 discloses a metal surface activating agent containing titanium phosphate and one or more copper compounds, and further containing phosphoric acid and phosphonic acid. However, stability in the concentrated solution was not considered, and enhancement of the function in terms of surface conditioning was also not considered.

Patent Document 1: Japanese Unexamined Patent Application No. H5-247664

Patent Document 2: Japanese Unexamined Patent Application No. H4-254589

DISCLOSURE OF THE INVENTION

The present invention was conceived taking into account the aforementioned current status, an object of the invention being to provide a surface conditioning composition in which a titanium phosphate compound can be stored in the state of a dispersion liquid for a long period of time while being stably present in the dispersion liquid, with favorable stability also in the bath, and with the composition being capable of forming a conversion coating film of a sufficient amount even in the case of application to conversion resistant metal materials such as high-tensile steel sheets.

The present inventors extensively investigated for the purpose of solving the aforementioned problems. Consequently, it was found that the foregoing problems can be solved by blending an amine compound having a specified structure, an aromatic organic acid, a phenolic compound, a phenolic resin and the like in a surface conditioning composition having a specified pH. Accordingly, the present invention was accomplished. More specifically, aspects of the present invention are to provide the following;

In a first aspect of the present invention, a surface conditioning composition contains a titanium phosphate compound and having a pH of 3 to 12, the surface conditioning composition further containing an amine compound represented by the following general formula (1):

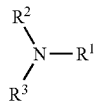

(1)

wherein, $R^1$, $R^2$, and $R^3$ each independently represent a hydrogen atom, a straight or branched alkyl group having 1 to 10 carbon atoms, or a straight or branched alkyl group having 1 to 10 carbon atoms and having a polar group in the skeleton thereof; however, $R^1$, $R^2$, and $R^3$ are not all a hydrogen atom.

In a second aspect of the present invention, the surface conditioning composition according to the first aspect further contains at least one selected from a group consisting of an aromatic organic acid, a phenolic compound, and a phenolic resin.

In a third aspect of the present invention, the surface conditioning composition according to the first or the second aspect the polar group is a hydroxyl group.

In a fourth aspect of the present invention, the surface conditioning composition containing a titanium phosphate compound and having a pH of 3 to 12, the surface conditioning composition further contains at least one selected from the group consisting of an aromatic organic acid, a phenolic compound, and a phenolic resin.

In a fifth aspect of the present invention, the surface conditioning composition according to any one of the first to fourth aspects further contains at least one selected from the group consisting of water dispersible resin particles, a clay compound, oxide fine particles, and a water soluble thickening agent.

In a sixth aspect of the present invention, the surface conditioning composition according to any one of the first to fifth aspects further contains at least one selected from the group consisting of a water soluble carboxyl group-containing resin, a saccharide, and a phosphonic acid compound.

In a seventh aspect of the present invention, the surface conditioning composition according to any one of the first to sixth aspects further contains at least one selected from the group consisting of a chelating agent and a surfactant.

In an eighth aspect of the present invention, the surface conditioning composition according to any one of first to seventh aspects further contains at least one ion selected from the group consisting of a Zr complex ion and an oxidized metal ion.

In a ninth aspect of the present invention, a surface conditioning method includes the step of bringing a surface conditioning composition, according to any one of the first to eighth aspects, into contact with a metal material surface.

Because the surface conditioning composition of the present invention is constituted as in the foregoing, it is superior in dispersion stability, can be stored in the liquid state for a long period of time, and also has superior stability in the bath. In addition, the surface conditioning effect is also improved, and a favorable conversion coating film can be formed when it is applied to any one of a variety of metal materials. Particularly, even when it is applied to aluminum or a high-tensile steel sheet that is a conversion resistant metal material, a dense conversion coating film can be formed. Therefore, the surface conditioning composition of the present invention can be suitably utilized for various kinds of materials used in automotive bodies, home electrical appliances, and the like.

PREFERRED MODE FOR CARRYING OUT THE INVENTION

The present invention is explained below in detail.

The titanium phosphate compound takes a form of extremely fine particles. When it is used as a surface conditioning agent prior to a phosphate treatment, it is expected to form many active spots on the metal surface at a high density, thereby functioning as a surface conditioning agent with high performance. However, as described above, the surface conditioning agents containing the titanium phosphate compound have a variety of drawbacks.

In accomplishing the present invention, the present inventors investigated grounds for occurrence of the aforementioned drawbacks of the surface conditioning agent in which the titanium phosphate compound was used. As a result, it was postulated that aggregation of the titanium phosphate compound would be a major cause of the drawbacks. More specifically, the titanium phosphate compound aggregates in a solution to increase the particle diameter in a time dependent manner, which results in sedimentation to decrease the amount of effective component, thereby leading to significant deterioration of the functionality as the surface conditioning agent.

Furthermore, not only in the case of the titanium phosphate compound being present in a solution, it also aggregates on the substrate surface in the case in which it adheres on the surface of the subject of the treatment. Consequently, the number of parts which could be the active spot of the reaction decreases as compared with the number of the adhered particles, and this is suspected to also be the cause of deterioration of the performance of the chemical conversion treatment.

For example, in the case of the aluminum-based substrate, a metal compound layer is formed on the surface under normal conditions. Specifically, it is a layer of a compound represented by the general formula: $Al(OH)_x$. Therefore, it is speculated that a coating film of aluminum phosphate is formed on the surface by way of phosphoric acids in the surface conditioning agent when the treatment is carried out with the surface conditioning agent containing the titanium phosphate compound. It is believed that the activity of the chemical conversion treatment reaction by the phosphate is lowered due to such a layer, whereby formation of the conversion coating film may become difficult.

In order to improve such defects, enhancement of the dispersibility of the titanium phosphate compound has been intended using a dispersant. Enhancement of the dispersion stability of inorganic particles by a dispersant has been carried out in a variety of technical fields, in particular, a phosphoric acid compound, a saccharide, a resin having a hydrophilic functional group or the like is often used. However, even though such a component is used, the enhancing effect on the stability was not sufficient, and thus, the aforementioned defects could not be completely improved.

Accordingly, the present inventors studied various compounds on the basis of the abovementioned respects, and found compounds that achieve a particularly superior effect in enhancing the dispersibility of the titanium phosphate compound. Consequently, the present invention was achieved.

First Embodiment

The surface conditioning composition according to a first embodiment is a surface conditioning composition that contains a titanium phosphate compound and has a pH of 3 to 12, and that further contains an amine compound (a) represented by the following general formula (1):

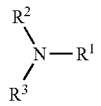

(1)

wherein, $R^1$, $R^2$, and $R^3$ each independently represent a hydrogen atom, a straight or branched alkyl group having 1 to 10 carbon atoms, or a straight or branched alkyl group having 1 to 10 carbon atoms and having a polar group in the skeleton thereof; however, $R^1$, $R^2$, and $R^3$ are not all a hydrogen atom.

According to this surface conditioning composition, the stability of the titanium phosphate compound in water is dramatically enhanced as compared with conventional cases. Thus, the titanium phosphate compound can be stably prepared, and can adhere to the substrate surface intimately.

The aforementioned amine compound (a) has a favorable property which enhances the dispersion stability of the titanium phosphate compound. Although the mechanism by which the amine compound (a) achieves the favorable property as a dispersant is unclear; it is speculated to result from its chemical structure. More specifically, the amine compound (a) has a nitrogen atom including a lone electron pair, and has a low molecular weight; therefore, it is speculated that the nitrogen atom is coordinated on the surface of the titanium phosphate compound particle, thereby enhancing the dispersion stability. Additionally, when the amine compound (a) has a further polar group in its skeleton, the dispersion stability is further enhanced.

The surface conditioning composition according to the first embodiment is advantageous in that it can be stored for a long period of time even in the state of a concentrated liquid because the titanium phosphate compound is highly stable. Moreover, stability under the conditions of the surface conditioning treatment bath is also favorable. Furthermore, it is superior in achieving an effect of providing favorable chemical conversion properties in the chemical conversion reaction, and thus, a conversion coating film of a sufficient amount can be formed even in the case in which it is applied to conversion resistant metal materials such as high-tensile steel sheets and the like.

Amine Compound (a)

The aforementioned amine compound (a) is not particularly limited, as long as it is a compound represented by the above general formula (1). The polar group in the general formula (1) is not particularly limited, but for example, may be constituted of a hydroxyl group, a carboxyl group, a sulfonic acid group, an amino group and the like. Among these, a hydroxyl group is particularly preferred.

Specific examples of the amine compound (a) include triethylamine, ethylenediamine, diethyldiamine, tri(n-butyl) amine, n-propylamine, triethylenetetramine, hydrazine, taurine, adipic acid dihydrazide and the like, as well as amino carboxylic acids such as NTA (Nitrilo Triacetic Acid), DTPA (Diethylene Triamine Pentaacetic Acid), EDTA (Ethylene Diamine Tetraacetic Acid), HIDA (Hydroxyethyl Imino Diacetic Acid), DHEG (Dihydroxyethyl Glycine), and the like.

Furthermore, examples of particularly preferably used amine compounds having a hydroxyl group include aliphatic hydroxyamine compounds such as monoethanolamine, diethanolamine, dimethylethanolamine, methyldiethanolamine, triethanolamine, triisopropanolamine and aminoethylethanolamine, aromatic amine compounds such as amine modified resol and amine modified novolak, and the like. These amine compounds may be used alone, or two or more thereof may be used in combination. Of these, aliphatic hydroxyamine compounds are preferred, and diethanolamine, dimethylethanolamine and triethanolamine are more preferred in light of superior adsorptivity to the titanium phosphate compound, difficulty in secondary aggregation, and superior dispersion stability in liquids.

With respect to the content of the amine compound (a), it is preferred that the lower limit be 0.01% by mass, and the upper limit be 1000% by mass on the basis of the mass of the titanium phosphate compound (solid content) at the metal material surface conditioning. When the content is less than 0.01% by mass, the amount of adsorption to the titanium phosphate compound becomes insufficient, whereby the effect of adsorption of the titanium phosphate compound to the metal material cannot be anticipated, and thus, the surface conditioning effect may not be achieved. The content of greater than 1000% by mass is not economical because the effect of exceeding a desirable effect can nevertheless not be achieved. The lower limit is more preferably 0.1% by mass, while the upper limit is more preferably 100% by mass.

With respect to the amount of addition of the amine compound (a), it is preferred that the lower limit be 0.1% by mass, and the upper limit be 50% by mass in the concentrated liquid. When the amount is less than 0.1% by mass, the dispersion stability may not be satisfactorily enhanced. When the amount is greater than 50% by mass, dispersibility may be deteriorated due to the influence of excess additive, and it is not economical even if the dispersion is satisfactory. The lower limit is more preferably 0.5% by mass, while the upper limit is more preferably 20% by mass.

With respect to the content of the amine compound (a), it is preferred that the lower limit be 1 ppm, and the upper limit be 10000 ppm in the surface conditioning treatment bath. When the content is less than 1 ppm, the amount of adsorption to the titanium phosphate compound may be insufficient, whereby secondary aggregation may be likely to occur. The content of greater than 10000 ppm is not economical because the effect of exceeding a desirable effect can nevertheless not be achieved. The lower limit is more preferably 10 ppm, while the upper limit is more preferably 5000 ppm.

Second Embodiment

The surface conditioning composition according to a second embodiment is a surface conditioning composition that contains a titanium phosphate compound and has a pH of 3 to 12, and that further contains at least one compound (b) selected from a group consisting of an aromatic organic acid, a phenolic compound, and a phenolic resin.

The compound (b) has an action to stabilize the titanium phosphate compound similarly to the amine compound (a) described above. Moreover, it has a particularly superior property as the surface conditioning agent in the chemical conversion treatment of the aluminum-based substrate. Specifically, although conventional surface conditioning agents containing the titanium phosphate compound do not achieve a sufficient effect in the treatment of the aluminum-based substrate; the surface conditioning agent according to this embodiment can form a favorable conversion coating film.

This occurrence may be caused by the following reason. A passive layer including a compound represented by the general formula $Al(OH)_x$ is formed on the surface of general aluminum-based substrates, and a coating film of aluminum phosphate is formed on the surface when a treatment with a surface conditioning composition containing the titanium phosphate compound is carried out. The coating film of the aluminum phosphate is formed through a reaction of phosphoric acid included in the titanium phosphate compound with the substrate surface. According to the aluminum-based substrate having this coating film of aluminum phosphate on the surface thereof, the surface conditioning function tends to be significantly deteriorated. It is speculated that the aluminum hydroxide layer and aluminum phosphate layer would prevent the reaction.

In contrast, because the aforementioned compound (b) is a compound that has a high affinity to aluminum metal, it is speculated that use of these compounds enables the titanium phosphate compound to be stably adhered to the substrate surface, and the function as the surface conditioning is thus improved. In addition, because the compound (b) has a function to chelate cation components in tap water, the temporal stability of the treatment bath can be maintained.

Compound (b)

The aforementioned aromatic organic acid is not particularly limited, but benzoic acid, salicylic acid, gallic acid, lignosulfonic acid, or tannic acid is preferably used. Among these, gallic acid, lignosulfonic acid, or tannic acid in particular is preferably used.

The aforementioned phenolic compound is not particularly limited as long as it is a compound having a phenolic hydroxyl group. For example, phenol, catechol, pyrogallol, or catechin is preferably used. Among these, catechin in particular is preferably used.

Examples of the phenolic resin include polymers having the aromatic organic acid and/or the phenolic compound as a basic skeleton (for example, polyphenolic compounds involving flavonoid, tannin, catechin and the like, polyvinyl phenol as well as water soluble resol, novolak resins and the like), lignin and the like.

The aforementioned flavonoid is not particularly limited, and examples thereof include flavone, isoflavone, flavonol, flavanone, flavanol, anthocyanidin, aurone, chalcone, epigallocatechin gallate, gallocatechin, theaflavin, daidzin, genistin, rutin, myricitrin, and the like.

The aforementioned tannin is a generic name of aromatic compounds which have a complicated structure having many phenolic hydroxyl groups, and which have widely distributed in the plant kingdom. The tannin may be either hydrolyzed tannin or condensed tannin. Examples of the tannin include hamameli tannin, persimmon tannin, tea tannin, oak gall tannin, gall nut tannin, myrobalan tannin, divi-divi tannin, algarovilla tannin, valonia tannin, catechin tannin, and the like. The tannin may also be hydrolyzed tannin yielded by decomposition with a process such as hydrolysis or the like of tannin found in a plant. Additionally, examples of the tannin which can be used also include commercially available ones such as "Tannic acid extract A", "B tannic acid", "N tannic acid", "Industrial tannic acid", "Purified tannic acid", "Hi tannic acid", "F tannic acid", "Official tannic acid" (all manufactured by Dainippon Pharmaceutical Co., Ltd.), "Tannic acid: AL" (manufactured by Fuji Chemical Industry Co., Ltd.), and the like. Two or more kinds of tannin may be concurrently used. For reference, the aforementioned lignin is a network polymer compound involving a phenol derivative as a base unit, to which a propyl group is bound.

With respect to the content of the compound (b), it is preferred that the lower limit be 0.01% by mass, and the upper limit be 1000% by mass on the basis of the mass of the titanium phosphate compound (solid content) in the metal material surface conditioning. When the content is less than 0.01% by mass, the amount of adsorption to the titanium phosphate compound becomes insufficient; therefore, the pulverizing effect in dispersion and the effect of adsorption of the titanium phosphate compound to the metal material cannot be anticipated, and thus, the surface conditioning effect may not be achieved. The content of greater than 1000% by mass is not economical because the effect exceeding a desirable effect can nevertheless not be achieved. The lower limit is more preferably 0.1% by mass, while the upper limit is more preferably 100% by mass.

With respect to the added amount of the compound (b), it is preferred that the lower limit be 0.1% by mass, and the upper limit be 50% by mass in the concentrated liquid. When the amount is less than 0.1% by mass, the dispersion may not be satisfactory. When the amount is greater than 50% by mass, dispersibility may be deteriorated due to the influence of excess additive, and is not advantageous in economical aspects even if the dispersion is satisfactory. The lower limit is more preferably 0.5% by mass, while the upper limit is more preferably 20% by mass.

With respect to the content of the compound (b), it is preferred that the lower limit be 1 ppm, and the upper limit be 10000 ppm in the surface conditioning treatment bath. When the content is less than 1 ppm, the amount of adsorption to the titanium phosphate compound may be insufficient, whereby secondary aggregation may be likely to occur. Content of greater than 10000 ppm is not economical because the effect exceeding a desirable effect can nevertheless not be achieved. The lower limit is more preferably 10 ppm, while the upper limit is more preferably 5000 ppm.

Third Embodiment

The surface conditioning composition according to a third embodiment is a surface conditioning composition that contains a titanium phosphate compound and has a pH of 3 to 12, and that further contains the amine compound (a) represented by the general formula (1), and at least one compound (b) selected from the group consisting of an aromatic organic acid, a phenolic compound, and a phenolic resin.

In the surface conditioning composition according to the third embodiment, the amine compound (a) and the compound (b) are used in combination, whereby crystals of more dense conversion coating film can be formed on the surface of a variety of metal materials. In particular, with respect to cold-rolled steel sheets and galvanized steel sheets, it is preferred in light of ability to uniformly and finely cover the entire face of the metal material.

Titanium Phosphate Compound

All of the surface conditioning compositions according to the above first, second, and third embodiments contain a titanium phosphate compound. The titanium phosphate compound is a crystal nucleus for attaining the surface conditioning function. Adhesion or the like of these particles to the metal material surface results in acceleration of the chemical conversion treatment reaction.

The titanium phosphate compound is not particularly limited, but titanium phosphate, titanium hydrogen phosphate or the like may be used. Also, any one generally used in the surface conditioning agent as a so-called Jernstedt salt can be used. The method for production of the titanium phosphate compound is not particularly limited, but, for example, powdery precipitates of the titanium phosphate compound can be obtained by adding titanyl sulfate and dibasic sodium phosphate into water in an airtight vessel, followed by heating, filtration, and pulverization.

The titanium phosphate compound preferably has an average particle diameter ($D_{50}$) of 3 μm or less, whereby a dense conversion coating film can be formed. When the particle diameter of the titanium phosphate compound is even greater, the stability of the titanium phosphate compound in the surface conditioning treatment bath may be insufficient, and thus, the titanium phosphate compound may sediment. Because the surface conditioning composition that contains the titanium phosphate compound having $D_{50}$ of 3 μm or less has superior stability of the titanium phosphate compound in the surface conditioning treatment bath, sedimentation of the titanium phosphate compound in the surface conditioning treatment bath can be suppressed, thereby enabling the formation of a dense conversion coating film.

It is more preferable that the lower limit of $D_{50}$ of the titanium phosphate compound be 0.001 μm. When $D_{50}$ is less than 0.001 μm, production efficiency may be inferior, which may lead to being less economical. $D_{50}$ is more preferably 0.01 μm or greater, and is more preferably 1 μm or less. When it is greater than 1 μm, the surface conditioning effect can not be achieved, whereby progress of the chemical conversion treatment reaction may be difficult.

$D_{50}$ is also referred to be 50% diameter by volume, indicating the particle diameter at a point of 50% on a cumulative curve which is yielded based on particle diameter distribution in an aqueous dispersion liquid, provided that the total volume of the particles accounts for 100%. The aforementioned $D_{50}$ can be measured by, for example, using an apparatus for measuring particle grade such as an electrophoretic light scattering photometer ("Photal ELS-800", trade name, manufactured by Otsuka Electronics Co., Ltd.) or the like. Herein, the description "average particle diameter" indicates the $D_{50}$.

With respect to the amount of blending the aforementioned raw material, the titanium phosphate compound in the surface conditioning composition, in general, is preferred to have a lower limit of 0.5% by mass, and an upper limit of 50% by mass in the aqueous dispersion liquid. When the amount is less than 0.5% by mass, the effect of the surface conditioning composition which should be achieved using the dispersion liquid may not be sufficiently achieved because of the titanium phosphate compound content being too low. In contrast, when the amount is greater than 50% by mass, it is probable to cause hardening.

Because the aforementioned surface conditioning composition is stable even at a high concentration with the amount of the blended titanium phosphate compound being 5% to 40% by mass, a superior effect to enable storage for a long period of time in the state of the liquid is achieved.

It is preferred that the content of the titanium phosphate compound be 10 ppm to 10000 ppm in the surface conditioning treatment bath. When the content is less than 10 ppm, the titanium phosphate compound to be the crystal nucleus may be deficient, whereby a sufficient surface conditioning effect may not be achieved. A content of greater than 10000 ppm is not economical because no addition to the desired effect is achieved. The content of the titanium phosphate compound is more preferably 100 ppm to 5000 ppm.

With regard to the aforementioned surface conditioning composition, it is preferred that the lower limit of the pH is 3, and the upper limit is 12. When the pH is less than 3, the titanium phosphate compound becomes likely to be readily dissolved, and unstable, which may affect the following step. When the pH is greater than 12, it may lead to elevation of the pH of the chemical conversion bath in the following step to cause influences of defective chemical conversion. The lower limit is preferably 6, while the upper limit is preferably 11.

Compound (c)

It is preferred that the surface conditioning composition further contains at least one compound (c) selected from the group consisting of water dispersible resin particles, a clay compound, oxide fine particles, and a water soluble thickening agent.

The compound (c) greatly improves the chemical conversion property through the addition to the surface conditioning composition of the present invention. Furthermore, it is speculated to be responsible for stabilization by way of interaction such as adsorption of the titanium phosphate compound, thereby contributing to stability during storage in the state of the aqueous dispersion liquid (concentrated liquid before use in surface conditioning) for a long period of time, stability of the surface conditioning treatment bath, and stability against hardening components such as calcium ions, magnesium ions and the like derived from tap water.

Additionally, it is speculated that the titanium phosphate compound becomes more resistant to sedimentation as compared with the case in which the compound (c) is not used because of the floatation effect or the like presumed to result from the compound (c), since the compound (c) interacts with the titanium phosphate compound. Therefore, by further including the compound (c), crystals of a more dense conversion coating film can be formed on the surface of a variety of metal materials. In particular, with respect to cold-rolled steel sheets, and galvanized steel sheets, it is preferred in light of ability to uniformly and finely cover the entire face of the metal material.

The aforementioned water dispersible resin particle is not particularly limited as long as it is a resin particle that is insoluble in water and does not sediment in water, which should be a resin particle uniformly dispersed in an aqueous solvent. Specific examples include resin particle emulsions obtained by emulsion polymerization, resin particles obtained by suspension polymerization, nonaqueous dispersion polymerization or the like, and the like. The water dispersible resin particle may or may not have an internal cross-linked structure.

The water dispersible resin particle is preferably constitutes a resin having a hydrophilic functional group such as a carboxyl group, a hydroxyl group, a sulfone group, a phosphone group, a polyalkylene oxide group, an amino group, or an amide group. In accordance with the water dispersible resin particle having the hydrophilic functional group, it is speculated that a hydrophilic functional group and resin-dissolving chains having a hydrophilic functional group tend to localize on the surface of the resin particle, and thus, the hydrophilic functional group and the resin-dissolving chain interact with the titanium phosphate compound, whereby the water dispersible resin particle is responsible for stabilization of the titanium phosphate compound in the aqueous solvent. Moreover, it is speculated that interaction between the metal material and the titanium phosphate compound is also caused by the water dispersible resin particle to provide favorable chemical conversion properties. In addition, it is speculated that the hydrophilic functional group is likely to be orientated to the surface; therefore, an electric double layer is formed, whereby the stabilization of the particles is ensured due to the structural repulsion. In further concentrated stock liquids, a thixotropic effect is also responsible for stabilization accomplished by the titanium phosphate compound being the fine particles.

The type of the resin in the aforementioned water dispersible resin particle is not particularly limited, but known resin particles of an acrylic resin, a styrene resin, a polyester resin, an epoxy resin, a polyurethane resin, a melamine resin or the like can be used. Among these, the acrylic resin and/or styrene resin may be preferred. The water dispersible resin particle constituted with an acrylic resin and/or a styrene resin can be obtained by polymerization of an ethylenic unsaturated monomer composition having one ethylenic unsaturated bond in one molecule such as (meth)acrylic acid, (meth) acrylate ester and styrene.

The aforementioned ethylenic unsaturated monomer is not particularly limited, and examples thereof include, ethylenic unsaturated carboxylate monomers such as (meth)acrylic acid, maleic acid, and itaconic acid; (meth)acrylate ester monomers such as methyl (meth)acrylate, ethyl (meth)acrylate, n-butyl (meth)acrylate, 2-ethyl hexyl (meth)acrylate, 2-hydroxyethyl (meth)acrylate, 2-hydroxypropyl (meth) acrylate, 4-hydroxybutyl (meth)acrylate, reaction product of 2-hydroxyethyl (meth)acrylate and ε-caprolactone, aminoethyl (meth)acrylate, dimethylaminoethyl (meth)acrylate, butylaminoethyl (meth)acrylate, glycidyl (meth)acrylate, and polyethylene glycol mono(meth)acrylate; monoester monomers of an ethylenic unsaturated dicarboxylic acid such as ethyl maleate, butyl maleate, ethyl itaconate, and butyl itaconate; (meth)acrylamides, and derivatives thereof such as aminoethyl(meth)acrylamide, dimethylaminomethyl(meth) acrylamide, methylaminopropyl(meth)acrylamide, N-methylol(meth)acrylamide, methoxybutyl(meth)acrylamide, and diacetone (meth)acrylamide; cyanide vinyl-based monomers such as (meth)acrylonitrile, and α-chloro(meth)acrylonitrile; vinyl ester monomers such as vinyl acetate, and vinyl propionate; aromatic monomers such as styrene, α-methylstyrene, and vinyltoluene, and the like. With regard to the monomer having an ethylenic unsaturated double bond, the aforementioned monomer may be used alone, or two or more components may be used in combination.

Also, internally cross-linked water dispersible resin particle may be prepared using a monomer having two or more ethylenic unsaturated bonds in one molecule. The monomer having two or more ethylenic unsaturated bonds in one molecule is not particularly limited, and examples thereof include, unsaturated monocarboxylate esters of polyhydric alcohol such as ethylene glycol di(meth)acrylate, triethylene glycol di(meth)acrylate, tetraethylene glycol di(meth)acrylate, 1,3-butylene glycol di(meth)acrylate, trimethylolpropane tri(meth)acrylate, 1,4-butanediol di(meth)acrylate, neopentylglycol di(meth)acrylate, 1,6-hexanediol di(meth) acrylate, pentaerythritol di(meth)acrylate, pentaerythritol tri (meth)acrylate, pentaerythritol tetra(meth)acrylate, glycerol di(meth)acrylate, glycerol di(meth)acrylate, glycerolallyloxy di(meth)acrylate, 1,1,1-trishydroxymethylethane di(meth) acrylate, 1,1,1-trishydroxymethylethane tri(meth)acrylate, 1,1-trishydroxymethylpropane di(meth)acrylate, and 1,1,1-trishydroxymethylpropane tri(meth)acrylate; unsaturated alcohol esters of polybasic acid such as triallyl cyanurate, triallyl isocyanurate, triallyl trimellitate, diallyl terephthalate, and diallyl phthalate; aromatic monomers substituted with two or more vinyl groups such as divinyl benzene, and the like.

The aforementioned water dispersible resin particle is preferably an acrylic resin particle and/or styrene resin particle having a designed hydrophilic functional group value of 1 to 200, which is obtained by radical polymerization of an ethylenic unsaturated monomer composition. By using the water dispersible resin particle, a particularly favorable effect to enhance the dispersion stability of the titanium phosphate compound can be achieved.

In addition, the designed hydrophilic functional group value represents a calculated value (mg) derived by multiplying the number of moles of the hydrophilic functional group such as a carboxyl group, a hydroxyl group, a sulfone group, a phosphone group, a polyalkylene oxide group, an amino group, and an amide group in 1 g of the monomer composition by the molecular weight of potassium hydroxide (molecular weight: 56.10). For example, in the case of the designed hydrophilic functional group value of the resin particle obtained by radical polymerization being 3 parts by mass of methacrylic acid (molecular weight: 86), that is a monomer having one carboxyl group in one molecule and 97 parts by mass of methyl methacrylate (molecular weight: 100), that is a monomer not having a hydrophilic functional group, the number of moles of the hydrophilic functional group (herein, carboxyl group in methacrylic acid) in one g of the monomer composition is first determined (in the present case, determined to be 0.00035 mol) Next, determination is made through multiplying the above value by the molecular weight of potassium hydroxide (in the present case, the designed hydrophilic functional group value determined to be about 20). Also, in the case of monomers having a hydrophilic functional group other than the carboxyl group in one molecule, the designed hydrophilic functional group value can be determined similarly. When the designed hydrophilic functional group value is less than 1, the effect of the present invention may not be achieved. Moreover, when the designed hydrophilic functional group value is greater than 200, it becomes difficult to industrially obtain the hydrophilic resin particle.

The water dispersible resin particle preferably has $D_{50}$ of less than 3 μm, and it is more preferred that the lower limit be 0.01 μm, and the upper limit be 1 μm. When $D_{50}$ is less than 0.01 μm, industrial production becomes difficult, although satisfactory performance may be attained. When $D_{50}$ is greater than 1 μm, it becomes likely to sediment without adsorption to the titanium phosphate compound, whereby stability of the titanium phosphate compound may deteriorate.

The aforementioned clay compound is not particularly limited, and examples thereof include, smectites such as montmorillonite, beidellite, saponite, and hectorite; kaolinites such as kaolinite, and halloysite; vermiculites such as dioctahedral vermiculite, and trioctahedral vermiculite; micas such as teniolite, tetrasilicic mica, muscovite, illite, sericite, phlogopite, and biotite; hydrotalcite; pyrophilolite; layered polysilicates such as kanemite, makatite, ilerite, magadiite, and kenyaite, and the like. These clay compounds may be either a naturally occurring mineral or a synthetic mineral yielded by hydrothermal synthesis, a melt process, a solid phase process, or the like.

Furthermore, it is preferred that the average particle diameter of the clay compound in the dispersed state in water be 0.1 μm or less. When a clay compound having an average particle diameter in the dispersed state in water of greater than 0.1 μm is applied, dispersion stability may be deteriorated. Additionally, the average aspect ratio (mean value of maximum size/minimum size) of the clay compound is more preferably 10 or greater, and still more preferably 20 or greater. When the average aspect ratio is less than 10, the dispersion stability may deteriorate. The aforementioned average particle diameter in the dispersed state in water can be determined by TEM or SEM following lyophilization of the water dispersion liquid. Also, two or more of these may be concurrently used.

Additionally, intercalation compounds of the aforementioned clay compound (pillared crystals and the like), as well as those subjected to an ion exchange treatment, or to surface modification such as a silane coupling treatment, a composite formation treatment with an organic binder, or the like, can be used as required. These clay compounds may be used alone, or two or more may be used in combination. Examples of commercially available product of the saponite include synthetic saponite ("Sumecton SA", trade name, manufactured by Kunimine Industries Co., Ltd.), and the like. Examples of commercially available product of the natural hectorite include "BENTON EW" and "BENTON AD" (both manufactured by ELEMENTIS plc), and the like. Examples of commercially available product of the synthetic hectorite include trade names "Laponite B, S, RD, RDS, XLG, XLS" and the like manufactured by ROOKWOOD Additives Ltd. These are in the state of a white powder and readily form sol ("Laponite S, RDS, XLS") or gel ("Laponite B, RD, XLG") upon addition to water. Additionally, "Lucentite SWN" of Co-Op Chemical Co., Ltd. may also be exemplified. These natural hectorites and synthetic hectorites may be used alone, or two or more may be used in combination.

The aforementioned oxide fine particle is not particularly limited, and examples thereof include silica particles, alumina particles, titania particles, zirconia particles, niobium oxide particles, and the like. The oxide particles suitably have an average particle diameter of approximately 1 nm to 300 nm. These may be used alone, or two or more may be used in combination. Among these, in light of thixotropic properties, alumina particles and silicic acid compound may be preferably used.

The aforementioned water soluble thickening agent is not particularly limited, and examples thereof include polyamide-based thickening agents such as a swollen dispersion of fatty amide, amide-based fatty acid such as acrylamide, and phosphate of long-chain polyaminoamide; inorganic pigments such as aluminum silicate, and barium sulfate; flat pigments that produce viscosity due to the shape of the pigment, and the like. Among these, in light of low likelihood of causing inhibition of the chemical conversion, acrylamide, polyacrylic acid, and acrylic acid copolymers are preferably used.

With respect to the content of the compound (c), it is preferred that the lower limit be 0.01% by mass and the upper limit be 1000% by mass on the basis of the mass of the titanium phosphate compound (solid content). When the content is less than 0.01% by mass, the amount of adsorption to the titanium phosphate compound becomes insufficient, whereby the effect of adsorption of the particles to the metal material may not be sufficient, which may lead to inaccurately anticipating the effect of addition. A content of greater than 1000% by mass is not economical because no addition to the desired effect is achieved. The lower limit is more preferably 0.1% by mass, while the upper limit is more preferably 100% by mass.

With respect to the added amount of the compound (c), it is preferred that the lower limit be 0.1% by mass, and the upper limit be 50% by mass in the concentrated liquid. When the amount is less than 0.1% by mass, the dispersion may not be satisfactory. When the amount is greater than 50% by mass, dispersibility may deteriorate due to the influence of excess additive, and is not economical even if the dispersion is satisfactory. The lower limit is more preferably 0.5% by mass, while the upper limit is more preferably 20% by mass.

With respect to the content of the compound (c), it is preferred that the lower limit be 1 ppm, and the upper limit be 1000 ppm in the surface conditioning treatment bath. When the content is less than 1 ppm, the amount of adsorption of the titanium phosphate compound may be insufficient; therefore, adsorption and the like of the titanium phosphate compound to the metal material surface may not be facilitated. A content of greater than 1000 ppm is not economical because no additional desirable effect can be achieved. The lower limit is more preferably 10 ppm, while the upper limit is more preferably 500 ppm.

To include all of compounds (a) to (c) as described above is preferred in light of stabilization of the titanium phosphate compound in an aqueous solution, adsorption of the particles to the substrate, and stability in the concentrated liquid.

Moreover, a variety of components for use in the surface conditioning compositions may be added to the aforementioned surface conditioning composition, in addition to the compounds as described in the above.

Compound (d)

The aforementioned surface conditioning composition may further contain at least one compound (d) selected from the group consisting of a water soluble carboxyl group-containing resin, saccharide, and a phosphonic acid compound.

The aforementioned compound (d) tends to be negatively charged in a solution, and adhesion or the like of the same to the surface of the titanium phosphate compound results in an electromagnetically repulsive action. Consequently, it is speculated that reaggregation of the titanium phosphate compound is suppressed, making adhesion on the metal material surface as the crystal nucleus easier at a uniform density, and thus, a phosphate coating film of sufficient amount can be formed on the metal material surface in the chemical conversion treatment.

The aforementioned compound (d) not only suppresses sedimentation of the titanium phosphate compound in the surface conditioning composition, but also suppresses sedimentation of the titanium phosphate compound in the aqueous dispersion liquid of the titanium phosphate compound (concentrated liquid before use in surface conditioning). Accordingly, long-term storage stability of the concentrated liquid can be maintained.

The water soluble carboxyl group-containing resin is not particularly limited as long as it is a water soluble resin, and examples thereof include resins obtained by polymerization of a monomer composition containing a carboxyl group-containing ethylenic unsaturated monomer such as (meth) acrylic acid, maleic acid or fumaric acid, and the like. The water soluble carboxyl group-containing resin is preferably a resin that is obtained by radical polymerization of an ethylenic unsaturated monomer composition and has an acid value of 10 to 500. By using such a resin, the dispersion stability of the titanium phosphate compound can be further enhanced. The water soluble carboxyl group-containing resin may be a commercially available product, and, for example, "Aron A12SL" (manufactured by Toagosei Chemical Industry Co., Ltd.) can be used.

The aforementioned saccharide is not particularly limited, and examples thereof include polysaccharides, polysaccharide derivatives, and alkali metal salts such as sodium salts and potassium salts thereof, and the like. Examples of the polysaccharide include cellulose, methyl cellulose, ethyl cellulose, methylethyl cellulose, hemicellulose, starch, methyl starch, ethyl starch, methylethyl starch, agar, carrageen, alginic acid, pectic acid, guar gum, tamarind seed gum, locust bean gum, konjac mannan, dextran, xanthan gum, pullulan, gellan gum, chitin, chitosan, chondroitin sulfate, heparin, hyaluronic acid, and the like. Moreover, examples of the polysaccharide derivative include carboxyalkylated or hydroxyalkylated polysaccharides described above such as carboxymethyl cellulose (CMC) and hydroxyethyl cellulose, starch glycolic acid, agar derivatives, carrageen derivatives, and the like.

Examples of the phosphonic acid compound include phosphonic acid, and products yielded by direct binding of a carbon atom and a phosphorus atom, as well as amine salts or ammonium salts thereof, but phosphoric acid esters are not included.

In the surface conditioning composition as described above, the content of the compound (d) is preferably 0.01% to 1000% by mass on the basis of the mass of the titanium phosphate compound (solid content). When the content is less than 0.01% by mass, the preventing sedimentation effect may not be sufficiently achieved. A content of greater than 1000% by mass is not economical because no additional desirable effect can be achieved. The concentration is more preferably 0.1% to 100% by mass.

Furthermore, the content of the compound (d) in the concentrated liquid is preferably 0.1% to 40% by mass.

The content of the compound (d) is preferably 1 ppm or greater and 1000 ppm or less in the surface conditioning treatment bath. When the content is less than 1 ppm, effect of preventing sedimentation may not be sufficiently achieved. The content of greater than 1000 ppm is not economical because the effect exceeding a desirable effect cannot be nevertheless achieved. The concentration is more preferably 10 ppm or greater and 500 ppm or less.

Compound (e)

The aforementioned surface conditioning composition may further include a compound (e) that is a chelating agent and/or a surfactant. By including the compound (e), more superior dispersion stability can be achieved, and properties in dispersion stability can be improved. More specifically, even in the case in which hardening components, such as calcium ions, magnesium ions, and the like derived from tap water, contaminate the surface conditioning composition, the stability of the surface conditioning treatment bath can be maintained without aggregation of the titanium phosphate compound. Accordingly, the aforementioned chelating agent means a compound having the ability to capture the magnesium ions and calcium ions in an aqueous solution.

The chelating agent is not particularly limited, and examples thereof include citric acid, tartaric acid, EDTA, gluconic acid, succinic acid and malic acid, and compounds and derivative of the same.

The content of the chelating agent is preferably 1 ppm to 10000 ppm in the surface conditioning treatment bath. When the content is less than 1 ppm, hardening components in tap water cannot be chelated enough, whereby metal polycations such as calcium ions being the hardening component may allow the titanium phosphate compound to aggregate. A content of greater than 10000 ppm does not achieve any addition to the desired effect, and the chemical conversion properties may deteriorate through a reaction with active ingredients in the chemical conversion liquid. The content is more preferably 10 ppm to 1000 ppm.

As the aforementioned surfactant, an anionic surfactant or a nonionic surfactant may be more preferably used.

The aforementioned nonionic surfactant is not particularly limited, but nonionic surfactants having a hydrophilic lipophilic balance (HLB) of 6 or greater are preferred, and examples thereof include polyoxyethylene alkyl ether, polyoxyalkylene alkyl ether, polyoxyethylene derivatives, oxyethylene-oxypropylene block copolymers, sorbitan fatty acid esters, polyoxyethylene sorbitan fatty acid esters, polyoxyethylene sorbitol fatty acid esters, glycerin fatty acid esters, polyoxyethylene fatty acid esters, polyoxyethylene alkylamine, alkylalkanode amide, nonylphenol, alkylnonylphenol, polyoxyalkylene glycol, alkylamine oxide, acetylene diol, polyoxyethylene nonylphenyl ether, silicon based surfactants such as polyoxyethylene alkylphenyl ether-modified silicone, fluorine-based surfactants prepared through substitution of at least one hydrogen atom in a hydrophobic group of a hydrocarbon-based surfactant with a fluorine atom, and the like. Among them, polyoxyethylene alkyl ether and polyoxyalkylene alkyl ether are particularly preferred in light of further achievement of the advantageous effect of the present invention.

The aforementioned anionic surfactant is not particularly limited, and examples thereof include fatty acid salts, alkylsulfuric acid ester salts, alkyl ether sulfuric acid ester salts, alkylbenzenesulfonate, alkylnaphthalenesulfonate, alkylsulfosuccinate, alkyldiphenyl ether disulfonate, polybisphenol sulfonate, alkyl phosphate, polyoxyethylalkyl sulfuric acid ester salts, polyoxyethylalkylallylsulfuric acid ester salts, alpha-olefin sulfonate, methyl taurine acid salts, polyaspartate, ether carboxylate, naphthalenesulfonic acid-formalin condensates, polyoxyethylene alkyl phosphate esters, alkyl ether phosphoric acid ester salts, and the like. Among them, alkyl ether phosphoric acid ester salts are preferred in light of further achievement of the advantageous effect of the present invention.

With respect to the content of the surfactant, it is more preferred that the lower limit be 3 ppm, and the upper limit be 500 ppm in the surface conditioning treatment bath. When the content falls within the above range, the effect of the present invention can be favorably achieved. The lower limit is more preferably 5 ppm, while the upper limit is more preferably 300 ppm. The surfactant may be used alone, or two or more may be used in combination.

Ion (f)

It is preferred that the surface conditioning composition further contains a Zr complex ion and/or an oxidized metal ion (f). The ion (f) may be preferably used in light of elimination of segregation products on the substrate surface. The oxidized metal ion referred to herein means a metal ion having a higher valence in a metal having a plurality of valences. Specific examples include oxidized metal ions of Fe, Mn, Co, Ni, Ce, and the like.

The source of the Zr complex ion is not particularly limited, and examples thereof include zircon hydrofluoride, zirconium ammonium carbonate; hydroxylated zirconium, zirconium oxycarbonate, basic zirconium carbonate, zirconium borate, zirconium oxalate, zirconium sulfate, zirconium nitrate, zirconyl nitrate, zirconium chloride and the like; organic zirconium compounds such as dibutyl zirconium dilaurylate, dibutylzirconium dioctate, zirconium naphthenate, zirconium octylate and acetylacetone zirconium, and the like. Among these, zircon hydrofluoride and zirconyl nitrate are preferably used in light of elimination of segregation products on the substrate surface.

The source of the oxidized metal ion of Fe is not particularly limited, and examples thereof include water soluble ferric salts such as iron (III) sulfate, iron (III) nitrate, and iron (III) perchlorate; water soluble ferrous salts such as iron (II) sulfate, and iron (II) nitrate, and the like. Among these, ferric nitrate is preferably used in light of oxidation of the substrate surface.

The source of the oxidized metal ion of Mn is not particularly limited, and examples thereof include organic acid salts such as manganese acetate, manganese benzoate, manganese lactate, manganese formate, and manganese tartrate; harogenated products such as manganese chloride, and manganese bromide; inorganic acid salts such as manganese nitrate, manganese carbonate, manganese phosphate, manganese sulfate, and manganese phosphate; alkoxides such as manganese methoxide; acetylacetone manganese (II), acetylacetone manganese (III), manganese dioxide, manganese oxide, and the like. Among these, potassium permanganate may be preferably used in light of oxidation of the substrate surface.

The source of the oxidized metal ion of Co is not particularly limited, and examples thereof include cobalt nitrate, cobalt sulfate, and the like.

The source of the oxidized metal ion of Ni is not particularly limited, and examples thereof include carbonates such as nickel (II) carbonate, basic nickel (II) carbonate, and acidic nickel (II) carbonate; phosphates such as nickel (II) phosphate, and nickel pyrophosphate; nitrates such as nickel (II) nitrate, and basic nickel nitrate; sulfates such as nickel (II) sulfate; oxides such as nickel (II) oxide, trinickel tetraoxide, and nickel (III) oxide; acetates such as nickel (II) acetate, and nickel (III) acetate; oxalates such as nickel (II) oxalate; nickelamide sulfate, acetylacetone nickel (II), hydroxylated nickel (II), and the like.

The source of the oxidized metal ion of Ce is not particularly limited, and examples thereof include cerium nitrate, cerium sulfate, and the like.

With respect to the content of the ion (f), it is preferred that the lower limit is 0.01% by mass, and the upper limit is 10% by mass in the concentrated liquid. When the content is less than 0.01% by mass, the effect may not be achieved, while content greater than 10% by mass may result in instability of the concentrated liquid.

With respect to the content of the ion (f), it is preferred that the lower limit be 0.1 ppm, and the upper limit be 1000 ppm in the surface conditioning treatment bath. When the content is less than 0.1 ppm, the effect may not be achieved, while content greater than 1000 ppm will not achieve additional effects.

A bivalent or trivalent metal nitrite compound can be added to the surface conditioning composition as needed for still further suppress the generation of rust.

A metal alkoxide, a deforming agent, a rust-preventive agent, an antiseptic agent, a thickening agent, an alkaline builder such as sodium silicate, and the like may be further blended to the surface conditioning composition in a range not to inhibit the effect of the present invention, in addition to the components as described above. In order to cover for uneven degreasing, various surfactants may be added to improve the wettability.

The aforementioned surface conditioning composition can also include a dispersion medium for allowing the titanium phosphate compound to be dispersed. Examples of the dispersion medium include aqueous media containing 80% by mass or of more water. In addition, various water soluble organic solvents can be used as the medium other than water; however, the content of the organic solvent is desired to be as low as possible, and accounts for preferably 10% by mass or less of the aqueous medium, and more preferably 5% by mass or less. A dispersion liquid without including any dispersion media other than water may be also provided.

The water soluble organic solvent is not particularly limited, and examples thereof include alcoholic solvents such as methanol, ethanol, isopropanol, and ethylene glycol; ether-based solvents such as ethylene glycol monopropyl ether, butyl glycol, and 1-methoxy-2-propanol; ketone-based solvents such as acetone, and diacetone alcohol; amide-based solvents such as dimethyl acetamide, and methyl pyrrolidone; ester-based solvents such as ethyl carbitol acetate, and the like. These may be used alone, or two or more may be used in combination.

An alkali salt such as calcined soda may be further added to the surface conditioning composition for the purpose of stabilizing the titanium phosphate compound and forming a fine conversion film in the phosphate chemical conversion treatment step carried out subsequently.

The aforementioned surface conditioning composition can be produced by the following method for example. The titanium phosphate compound can be obtained using a titanium phosphate compound for use as a raw material in conventional surface conditioning compositions.

The shape of the raw material titanium phosphate compound is not particularly limited, but one having an arbitrary shape can be used. Although commercially available products are generally in the state of a white powder, the shape of the powder may be any one such as fine particulate, platy, squamous, or the like. Also, the particle diameter of the titanium phosphate compound is not particularly limited, but in general, a powder exhibiting $D_{50}$ of approximately several micrometers (μm) may be used. Particularly, commercially available products as rust preventive pigments may be suitably used such as products having an improved buffering action by subjecting to a treatment for imparting basicity. According to the present invention as described later, a stable dispersion liquid of the finely and uniformly dispersed titanium phosphate compound can be prepared irrespective of the primary particle diameter and shape as the raw material titanium phosphate compound.

According to the aforementioned aqueous dispersion liquid, an aqueous dispersion liquid with high concentration can also be obtained in which the titanium phosphate compound is blended in an amount of 10% by mass or more, further, 20% by mass or more, and particularly 30% by mass or more.

Other components (a bivalent or trivalent metal nitrite compound, a dispersion medium, a thickening agent, and the like) can also be admixed as needed into the aqueous dispersion liquid obtained as described in the foregoing. The method of mixing the aqueous dispersion liquid with the other component is not particularly limited, but for example, the other component may be added to and mixed with the aqueous dispersion liquid, or the other component may be blended during preparation of the aqueous dispersion liquid. Furthermore, the dispersion stability of the titanium phosphate compound can be enhanced by using any beads mills typified by disc type, pin type and the like, high-pressure homogenizers, medialess dispersion machines typified by ultrasonic dispersion machines. This is assumed to result from covering of the titanium phosphate compound by the aforementioned amine compound (a) or compound (b) that serves as a dispersant.

The surface conditioning composition is prepared by, for example, diluting the aforementioned aqueous dispersion liquid in water. The additive is preferably added as needed to the aqueous medium concurrently to the addition of the titanium phosphate compound; however, it may be added later to the aqueous dispersion liquid prepared by dispersing the titanium phosphate compound. The surface conditioning composition is superior in dispersion stability, and favorable surface conditioning can thereby be done to the metal material.

The surface conditioning method of the present invention includes the step of bringing the aforementioned surface conditioning composition into contact with a metal material surface. Hence, fine particles of the titanium phosphate compound can be adhered in a sufficient amount to the surface of not only iron-based and zinc-based metal materials, but also to conversion resistant metal materials such as aluminum and high-tensile steel sheets, and thus, a favorable conversion coating film can be formed in the chemical conversion treatment step.

The process for bringing the surface conditioning composition into contact with the metal material surface in the above surface conditioning method is not particularly limited, but a conventionally known method such as dipping or spraying can be freely employed.

The metal material to be subjected to the surface conditioning is not particularly limited, but the process can be applied to a variety of metals generally subjected to the phosphate conversion treatment, such as, for example, galvanized steel sheets, aluminum-based metal materials such as aluminum or aluminum alloys, magnesium alloys, or iron-based metal materials such as cold-rolled steel sheets and high-tensile steel sheets. Particularly, it can be suitably applied to cold-rolled steel sheets and high-tensile steel sheets.

Moreover, using the surface conditioning composition as described above, a step of surface conditioning in combination with degreasing can also be carried out. Accordingly, the step of washing with water following a degreasing treatment can be omitted. In the aforementioned step of surface conditioning in combination with degreasing, a known inorganic alkali builder, an organic builder or the like may be added for the purpose of increasing the detergency. Also, a known condensed phosphate or the like may be added. In the surface conditioning step as described above, the contact time of the surface conditioning composition with the metal material surface and the temperature of the surface conditioning composition are not particularly limited, but the process can be performed under conventionally known conditions.

After performing the surface conditioning, the phosphate chemical conversion treatment is then carried out to enable production of a phosphate chemical conversion treated metal sheet. The process for the phosphate chemical conversion treatment is not particularly limited, but any one of various known processes such as a dipping treatment, a spraying treatment, or an electrolytic treatment can be employed. Multiple kinds of these treatments may be conducted in combination. Furthermore, with regard to the phosphate crystal coating film to be deposited on the metal material surface, it is not particularly limited as long as it is a metal phosphate, and examples thereof include zinc phosphate, iron phosphate, manganese phosphate, calcium phosphate and the like, but not in any way limited thereto. In the phosphate chemical conversion treatment, the contact time of the chemical conversion treatment agent with the metal material surface and the temperature of the chemical conversion treatment agent are not particularly limited, but can be conventionally known conditions.

After carrying out the aforementioned surface conditioning and chemical conversion treatment, a coated sheet can be produced by carrying out further coating. In general, electrodeposition coating is employed as the coating process. The paint for use in the coating is not particularly limited, but may be of various types generally used in coating of a phosphate chemical conversion treated metal sheet, and examples thereof include epoxymelamine paints, as well as paints for cation electrodeposition, polyester-based intermediate coating paints and polyester-based over coating paints, and the like. Known processes may be employed in which a washing step is carried out after the chemical conversion treatment, and prior to the coating.

EXAMPLES

The present invention is explained in more detail below by way of Examples, but the present invention is not limited only to these Examples. In the following Examples, "part" or "%" each represents "part by mass" or "% by mass," respectively.

Production of Titanium Phosphate Compound

To 30 parts by mass of pure water were added 10 parts by mass of titanyl sulfate and 60 parts by mass of dibasic sodium phosphate. After baking with a hot kneader at 120° C. for 60 min, the mixture was filtrated to obtain a powder of a titanium phosphate compound.

Example 1

To 60 parts by mass of pure water were added 20 parts by mass of the titanium phosphate compound and 1 part by mass of diethanolamine. To this mixture was added pure water to fill up to 100 parts by mass. The mixture was allowed to disperse with an SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 2

To 60 parts by mass of pure water were added 20 parts by mass of the titanium phosphate compound and 1 part by mass based on the solid content of polyphosphoric acid ("SN2060", trade name, manufactured by San Nopco Limited). To the mixture was added pure water to fill up to 100 parts by mass. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 3

To 60 parts by mass of pure water were added 20 parts by mass of the titanium phosphate compound, 1 part by mass of tannic acid (reagent), and 1 part by mass of diethanolamine. To this mixture was added water to fill up to a total amount of 100 parts by mass, followed by neutralization with NaOH. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 4

To 60 parts by mass of pure water were added 10 parts by mass of the titanium phosphate compound, 0.5 parts by mass of tannic acid (reagent), and 1 part by mass of diethanolamine. To this mixture was added water to fill up to a total amount of 100 parts by mass, followed by neutralization with NaOH. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 5

To 60 parts by mass of pure water were added 20 parts by mass of the titanium phosphate compound, 1 part by mass of lignosulfonic acid ("SANX P252", trade name, manufactured by Nippon Paper Industries Co., Ltd.), and 5 parts by mass of water dispersible resin particles. To this mixture was added pure water to fill up to a total of 100 parts by mass. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 6

To 60 parts by mass of pure water were added 25 parts by mass of the titanium phosphate compound, 1 part by mass of tannic acid (reagent), 1 part by mass of saponite, and 1 part by mass of an acrylic resin ("Aron A12SL", trade name, manufactured by Toagosei Chemical Industry Co., Ltd.). To this mixture was added water to fill up to a total amount of 100 parts by mass, followed by neutralization with NaOH. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 7

To 60 parts by mass of pure water were added 20 parts by mass of the titanium phosphate compound, 3 parts by mass of dimethylethanolamine, 1 part by mass of gallic acid, and 1 part by mass of acrylamide. To this mixture was added pure water to fill up to a total of 100 parts by mass. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 8

To 60 parts by mass of pure water were added 20 parts by mass of the titanium phosphate compound, 1 part by mass of triethanolamine, 2 parts by mass of catechin, 1 part by mass of alumina sol, and 1 part by mass of phosphonic acid. To this mixture was added pure water to fill up to a total of 100 parts by mass. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 9

To 60 parts by mass of pure water were added 30 parts by mass of the titanium phosphate compound, 1 part by mass of dimethylethanolamine, 1 part by mass based on the solid content of SN2060 (supra), and 1 part by mass of zircon hydrofluoride. To this mixture was added pure water to fill up to a total of 100 parts by mass. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 10

To 60 parts by mass of pure water were added 20 parts by mass of the titanium phosphate compound, 3 parts by mass of triethyl amine, 1 part by mass of tannic acid (reagent), 5 parts by mass of water dispersible resin particles, and 1 part by mass of tribasic sodium phosphate. To this mixture was added water to fill up to a total amount of 100 parts by mass, followed by neutralization with NaOH. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Example 11

To 60 parts by mass of pure water were added 20 parts by mass of the titanium phosphate compound, 1 part by mass of diethanolamine, 3 parts by mass based on the solid content of SN2060 (supra), 1 part by mass of saponite, and 1 part by mass of a surfactant. To this mixture was added pure water for the rest to fill up to 100 parts by mass. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Comparative Example 1

To 60 parts by mass of pure water was added 20 parts by mass of the titanium phosphate compound. The mixture was allowed to disperse with the SG mill for 180 min at a filling ratio of zirconia beads (1 mm) of 80%. The dispersion liquid was poured into a bath with tap water to give a titanium phosphate compound concentration of 0.1%. To this mixture was added 0.005 parts by mass of sodium tripolyphosphate, and the surface conditioning composition was obtained through adjusting the pH to be 10 with caustic soda.

Comparative Example 2

To 60 parts by mass of pure water were added 20 parts by mass of the titanium phosphate compound and 1 part by mass of polyacrylic acid ("SN44C", trade name, manufactured by San Nopco Limited). To this mixture was added pure water to fill up to a total of 100 parts by mass. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Comparative Example 3

To 60 parts by mass of pure water were added 20 parts by mass of the titanium phosphate compound and 1 part by mass of carboxymethyl cellulose (CMC) ("APP84", trade name, manufactured by Nippon Paper Industries Co., Ltd.). To this mixture was added pure water to fill up to a total of 100 parts by mass. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Comparative Example 4

To 60 parts by mass of pure water were added 20 parts by mass of the titanium phosphate compound and 1 part by mass of PVA ("PVA105", trade name, manufactured by Kuraray Co., Ltd.). To this mixture was added pure water to fill up to a total of 100 parts by mass. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 10 with caustic soda.

Comparative Example 5

To 60 parts by mass of pure water were added 20 parts by mass of the titanium phosphate compound, 1 part by mass of tannic acid (reagent), and 1 part by mass of diethanolamine. To this mixture was added water to fill up to a total amount of 100 parts by mass, followed by neutralization with NaOH. The mixture was allowed to disperse with the SG mill for 180 min at a filling ratio of zirconia beads (1 mm) of 80%. The thus resulting dispersion liquid was poured into a bath with tap water to give a titanium phosphate compound concentration of 0.1%, and the surface conditioning composition was obtained through adjusting the pH to be 2.5 with caustic soda.

Comparative Example 6

A titanium-based powdery surface conditioning agent ("5N10", trade name, manufactured by Nippon Paint Co., Ltd.) was poured into a bath with tap water to give 0.1%, and the pH was adjusted to be 10 with NaOH.

Production of Test Sheet 1

A cold-rolled steel sheet (SPC) (70 mm×150 mm×0.8 mm), a galvanized steel sheet (GA) (70 mm×150 mm×0.8 mm), a #6000 aluminum sheet (Al) (70 mm×150 mm×0.8 mm), and a high-tensile steel sheet (70 mm×150 mm×1.0 mm) were respectively subjected to a degreasing treatment using a degreasing agent ("SURFCLEANER EC92", trade name, manufactured by Nippon Paint Co., Ltd.) at 40° C. for 2 min. Then, using each of the surface conditioning compositions of Examples 1 to 11 and Comparative Examples 1 to 6 obtained as described above, the surface conditioning treatment was carried out at room temperature for 30 sec. The constitution ratios of the surface conditioning compositions obtained as in the foregoing are shown in Table 1. Subsequently, each metal sheet was subjected to a chemical conversion treatment using a zinc phosphate treatment liquid ("SURFDINE 6350", trade name, manufactured by Nippon Paint Co., Ltd.) with a dipping method at 35° C. for 2 min, followed by washing with water, washing with pure water, and drying to obtain a test sheet.

TABLE 1

| | | Phosphate | | Amine compound (a) | | Compound (b) | | Compound (c) | |
|---|---|---|---|---|---|---|---|---|---|
| | pH | type | amount | type | amount | type | amount | type | amount |
| Example 1 | 10 | titanium phosphate | 20% | diethanol amine | 1% | — | — | — | — |
| Example 2 | 10 | titanium phosphate | 20% | — | — | polyphosphoric acid (SN2060) | 1% | — | — |
| Example 3 | 10 | titanium phosphate | 20% | diethanol amine | 1% | tannic acid-Na neutralized | 1% | — | — |
| Example 4 | 10 | titanium phosphate | 10% | diethanol amine | 1% | tannic acid-Na neutralized | 0.50% | — | — |
| Example 5 | 10 | titanium phosphate | 20% | — | — | lignosulfonic acid | 1% | water dispersible | 5% |
| Example 6 | 10 | titanium phosphate | 25% | — | — | tannic acid-Na neutralized | 1% | saponite | 1% |
| Example 7 | 10 | titanium phosphate | 20% | diethanol amine | 3% | gallic acid | 1% | acrylamide | 1% |
| Example 8 | 10 | titanium phosphate | 20% | triethanol amine | 1% | catechin | 2% | alumina sol | 1% |
| Example 9 | 10 | titanium phosphate | 30% | dimethyl ethanolamine | 1% | polyphosphoric acid (SN2060) | 1% | — | — |
| Example 10 | 10 | titanium phosphate | 20% | triethyl amine | 3% | tannic acid-Na neutralized | 1% | water dispersible | 5% |
| Example 11 | 10 | titanium phosphate | 20% | diethanol amine | 1% | polyphosphoric acid (SN2060) | 3% | saponite | 1% |
| Comparative Example 1 | 10 | titanium phosphate | 20% | — | — | — | — | — | — |
| Comparative Example 2 | 10 | titanium phosphate | 20% | — | — | — | — | — | — |
| Comparative Example 3 | 10 | titanium phosphate | 20% | — | — | — | — | — | — |
| Comparative Example 4 | 10 | titanium phosphate | 20% | — | — | — | — | — | — |
| Comparative Example 5 | 2.5 | titanium phosphate | 20% | diethanol amine | 1% | tannic acid-Na neutralized | 1% | — | — |
| Comparative Example 6 | 10 | | | powdery surface conditioning agent-5N10 (0.1%) built bath | | | | | |

| | Compound (d) | | Compound (e), Ion (f) | | Other additives | |
|---|---|---|---|---|---|---|
| | type | amount | type | amount | type | amount |
| Example 1 | — | — | — | — | — | — |
| Example 2 | — | — | — | — | — | — |
| Example 3 | — | — | — | — | — | — |
| Example 4 | — | — | — | — | — | — |
| Example 5 | — | — | — | — | — | — |
| Example 6 | acrylic resin | 1% | — | — | — | — |
| Example 7 | — | — | — | — | — | — |
| Example 8 | phosphonic acid | 1% | — | — | — | — |
| Example 9 | — | — | zircon hydrofluoride | 1% | — | — |

TABLE 1-continued

| | | | | | | |
|---|---|---|---|---|---|---|
| Example 10 | — | — | — | — | tribasic sodium | 1% |
| Example 11 | — | — | surfactant | 1% | — | — |
| Comparative Example 1 | — | — | — | — | sodium tripolyphos | 1% |
| Comparative Example 2 | polyacrylic acid | 1% | — | — | — | — |
| Comparative Example 3 | CMC (APP84) | 1% | — | — | — | — |
| Comparative Example 4 | PVA (PVA105) | 1% | — | — | — | — |
| Comparative Example 5 | — | — | — | — | — | — |
| Comparative Example 6 | powdery surface conditioning agent-5N10 (0.1%) built bath | | | | | |

Evaluation Test

According to the following methods, the particle diameter and stability of the titanium phosphate compound of the resulting surface conditioning composition were determined, and various evaluations of the test sheets thus obtained were conducted. The results are shown in Table 2.

Determination of Particle Diameter of Titanium Phosphate Compound

With respect to the particle diameter of the titanium phosphate compound included in the surface conditioning compositions obtained in Examples 1 to 11 and Comparative Examples 1 to 6, the particle diameter distribution was determined using an electrophoretic light scattering photometer ("Photal ELS-800", trade name, manufactured by Otsuka Electronics Co., Ltd.), and $D_{50}$ (average particle diameter of dispersion) was determined.

Appearance of Coating Film

The appearance of the formed conversion coating film was visually evaluated on the basis of the following standards. In the case in which rust was generated, it was designated as "generation of rust". In addition, the size of the crystals of the formed conversion coating film was measured with an electron microscope.

A: uniformly and finely covered on the entire face

B: roughly covered on the entire face

C: not covered in parts

CD: evaluated to fall within the scope between C and D

D: almost no conversion coating film formed

Amount of Conversion Coating Film

Using a fluorescent X-ray measurement apparatus ("XRF-1700", trade name, manufactured by Shimadzu Corporation), the mass of the conversion coating film was measured with the amount of P element included in the conversion coating film as a marker.

When the metal materials that were comparatively superior in chemical conversion treatment capability such as SPC and GA were used, higher conversion performance is decided as the particle diameter is smaller and as the amount of coating film is smaller, because formation of a crystal coating film as dense as possible is desired. In contrast, in the cases of conversion resistant metal materials such as the high-tensile steel sheets, an increase in the amount of the crystal coating film is required because of low chemical conversion treatment performances. Consequently, it has been determined that when there is a higher amount of coating film, the conversion performance is high.

Stability

The dispersion was left to stand at 40° C. for 30 days, and appearances and performances were then evaluated according to the following standards.

A: no abnormal appearance found, without alteration of the chemical conversion performance from the initial product B: appearance accompanied by separation, without alteration of the chemical conversion performance from the initial product C: sedimentation found, chemical conversion failed -: not evaluated

TABLE 2

| | | Appearance of coating film | | | | Appearance of coating film (crystal) μm | | | | Amount of zinc phosphate coating film (g/m$^2$) | | | |
|---|---|---|---|---|---|---|---|---|---|---|---|---|---|
| | Particle diameter μm | SPC | GA | Al | high-tensile steel sheet | SPC | GA | Al | high-tensile steel sheet | SPC | GA | high-tensile steel sheet | Stability |
| Example 1 | 0.1 | B | B | B | A | 2 | 4 | c.a. 10 | 4 | 1.8 | 2.9 | 1.9 | — |
| Example 2 | 0.1 | B | B | B | A | 2 | 4 | c.a. 10 | 4 | 1.8 | 2.8 | 2 | — |
| Example 3 | 0.1 | A | A | B | A | c.a. 1 | c.a. 1 | c.a. 5 | c.a. 1 | 1.6 | 2.4 | 1.7 | — |
| Example 4 | 0.1 | A | A | B | A | c.a. 1 | c.a. 1 | c.a. 5 | c.a. 1 | 1.7 | 2.5 | 1.9 | — |
| Example 5 | 0.08 | A | A | B | A | c.a. 1 | c.a. 1 | c.a. 5 | c.a. 1 | 1.7 | 2.4 | 1.9 | A |
| Example 6 | 0.08 | A | A | B | A | <1 | c.a. 1 | c.a. 5 | <1 | 1.5 | 2.3 | 1.7 | A |
| Example 7 | 0.1 | A | A | B | A | c.a. 1 | c.a. 1 | c.a. 5 | c.a. 1 | 1.6 | 2.3 | 1.8 | A |
| Example 8 | 0.15 | A | A | B | A | <1 | c.a. 1 | c.a. 5 | <1 | 1.6 | 2.3 | 1.7 | A |
| Example 9 | 0.1 | A | A | B | A | <1 | c.a. 1 | c.a. 5 | <1 | 1.6 | 2.3 | 1.7 | — |
| Example 10 | 0.08 | A | A | B | A | <1 | c.a. 1 | c.a. 5 | <1 | 1.5 | 2.3 | 1.6 | A |
| Example 11 | 0.1 | A | A | B | A | c.a. 1 | c.a. 1 | c.a. 5 | c.a. 1 | 1.6 | 2.3 | 1.7 | A |
| Comparative Example 1 | 0.2 | B | B | D | C generation of rust | 2 | 4 | — | — | 1.9 | 3.2 | — | C |

TABLE 2-continued

| | Particle diameter μm | Appearance of coating film | | | | Appearance of coating film (crystal) μm | | | | Amount of zinc phosphate coating film (g/m$^2$) | | | Stability |
|---|---|---|---|---|---|---|---|---|---|---|---|---|---|
| | | SPC | GA | Al | high-tensile steel sheet | SPC | GA | Al | high-tensile steel sheet | SPC | GA | high-tensile steel sheet | |
| Comparative Example 2 | 0.1 | CD | CD | D | — | — | — | — | — | — | — | — | C |
| Comparative Example 3 | 0.1 | CD | CD | D | — | — | — | — | — | — | — | — | B |
| Comparative Example 4 | 0.1 | CD | CD | D | — | — | — | — | — | — | — | — | C |
| Comparative Example 5 | — | D | D | D | — | — | — | — | — | — | — | — | C |
| Comparative Example 6 | 0.1 | B | B | D | C generation of rust | 2 | 4 | — | — | 1.9 | 3.2 | — | C |

As is clear from Table 2, it was ascertained that when the surface conditioning composition of Production Example was used, irrespective of being an aqueous dispersion liquid of the titanium phosphate compound, stable storage in the aqueous dispersion liquid was enabled for a long period of time, and that a favorable conversion coating film could be formed on all of the cold-rolled steel sheets, galvanized steel sheets, aluminum sheets, and high-tensile steel sheets.

The invention claimed is:

1. A surface conditioning composition comprising (i) a titanium phosphate compound and having a pH of 3 to 12, the surface conditioning composition further comprising (ii) an amine compound represented by the following general formula (1):

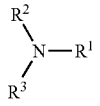

(1)

wherein, $R^1$, $R^2$, and $R^3$ are each selected from the group consisting of a hydrogen atom, a straight or branched alkyl group having 1 to 10 carbon atoms, and a straight or branched alkyl group having 1 to 10 carbon atoms and having a polar group in the skeleton thereof; and $R^1$, $R^2$, and $R^3$ are not all a hydrogen atom, and (iii) at least one aromatic organic compound selected from the group consisting of gallic acid, lignosulfonic acid, tannic acid, catechol, pyrogallol, and catechin.

2. A surface conditioning composition according to claim 1, wherein the polar group is a hydroxyl group.

3. A surface conditioning composition according to claim 1, further comprising at least one selected from the group consisting of a water soluble carboxyl group-containing resin, a saccharide, and a phosphonic acid compound.

4. A surface conditioning composition according to claim 1, further comprising at least one selected from the group consisting of a chelating agent and a surfactant.

5. A surface conditioning method comprising a step of bringing a surface conditioning composition, according to claim 1, into contact with a metal material surface.

6. A surface conditioning composition according to claim 1, further comprising (iv) at least one clay compound.

7. A surface conditioning composition according to claim 6, further comprising (v) at least one ion selected from the group consisting of a Zr complex ion and an oxidized metal ion.

8. A surface conditioning composition according to claim 1, further comprising (iv) at least one ion selected from the group consisting of a Zr complex ion and an oxidized metal ion.

* * * * *